US006033136A

United States Patent [19]

TeeBoon

[11] Patent Number: 6,033,136

[45] Date of Patent: Mar. 7, 2000

[54] FIELD-REPLACEABLE GUIDE RIBS FOR FILM PROCESSORS

[75] Inventor: Frederick W. TeeBoon, Rochester, N.Y.

[73] Assignee: Eastman Kodak Company, Rochester, N.Y.

[21] Appl. No.: 09/057,625

[22] Filed: Apr. 9, 1998

[51] Int. Cl.[7] ..... G03D 13/04; G03D 13/08

[52] U.S. Cl. ..... 396/645; 396/646; 396/612

[58] Field of Search ..... 396/612, 646, 396/620, 617, 615, 636, 645

[56] References Cited

U.S. PATENT DOCUMENTS

| | | | |
|---|---|---|---|
| 3,072,310 | 1/1963 | Kunz | 396/646 |
| 3,287,013 | 11/1966 | Fairbanks et al. | 396/612 |
| 4,345,832 | 8/1982 | Nomura et al. | 396/620 |
| 4,477,165 | 10/1984 | Spence et al. | 396/627 |
| 4,887,116 | 12/1989 | Uchiyama et al. | 396/619 |

*Primary Examiner*—D. Rutledge
*Attorney, Agent, or Firm*—Peyton C. Watkins

[57] ABSTRACT

A film processor for processing film comprises a stiffner for providing a support device; and fastenable guide ribs which are manually attachable to and detachable from the stiffner so as to permit field replacement of the ribs, and the stiffner and guide ribs cooperatively form a structure for passing the film through the film processor.

15 Claims, 3 Drawing Sheets

FIELD-REPLACEABLE GUIDE RIBS FOR FILM PROCESSORS

FIELD OF THE INVENTION

The invention relates generally to the field of guideshoes that pass film or paper through arcuate-shaped bends of transport systems in processors, such as film processors, and, more particularly, to such guideshoes having plastic, field-replaceable guide ribs.

BACKGROUND OF THE INVENTION

The processing of photosensitive material involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 liters of each processing solution. A small photofinishing apparatus or microlab utilizes tanks that may contain less than 10 liters of processing solution. Typically, large photofinishing apparatus and microlabs utilize fixed and integrated horizontal and vertical arrangements of racks and tanks.

Guideshoes are used for passing the film through arcuate-shaped bends of the tank and through arcuate-shaped bends between tanks. Guideshoes include a stainless steel base plate over which a plurality of integrally attached, spaced-apart, stainless steel ribs are placed for guiding the film through the bends.

Although the presently known and utilized apparatus for passing filn though bends of the tanks and between tanks is satisfactory, it is not without drawbacks. The guideshoes are manufactured as a single unit, and consequently, must be replaced in its entirety when any portion of it becomes damaged. More specifically, if any of the guide ribs must be replaced, the entire guideshoe must be replaced. In addition, stainless steel guideshoes are costly to manufacture and are not easily produced in various sizes and shapes.

Consequently, a need exists for guideshoes having field-replaceable parts, in particular guide ribs, so as to minimize cost during replacement.

SUMMARY OF THE INVENTION

The present invention is directed to overcoming one or more of the problems set forth above. Briefly summarized, according to one aspect of the present invention, the invention resides in a film processor for processing film comprising: (a) a stiffner for providing a support device; and (b) a plurality of fastenable guide ribs which are manually attachable to and detachable from said stiffner so as to permit field replacement of said ribs, and said stiffner and guide ribs cooperatively form a structure for passing the film through the film processor.

These and other aspects, objects, features and advantages of the present invention will be more clearly understood and appreciated from a review of the following detailed description of the preferred embodiments and appended claims, and by reference to the accompanying drawings.

ADVANTAGEOUS EFFECT OF THE INVENTION

The present invention has the advantages of having field-replaceable guide ribs which are easy to install, and of being produced from plastic which is cost efficient to manufacture. Still further, plastic ribs are easily produced in various sizes and shapes.

DETAILED DESCRIPTION OF THE INVENTION

Figure 1:
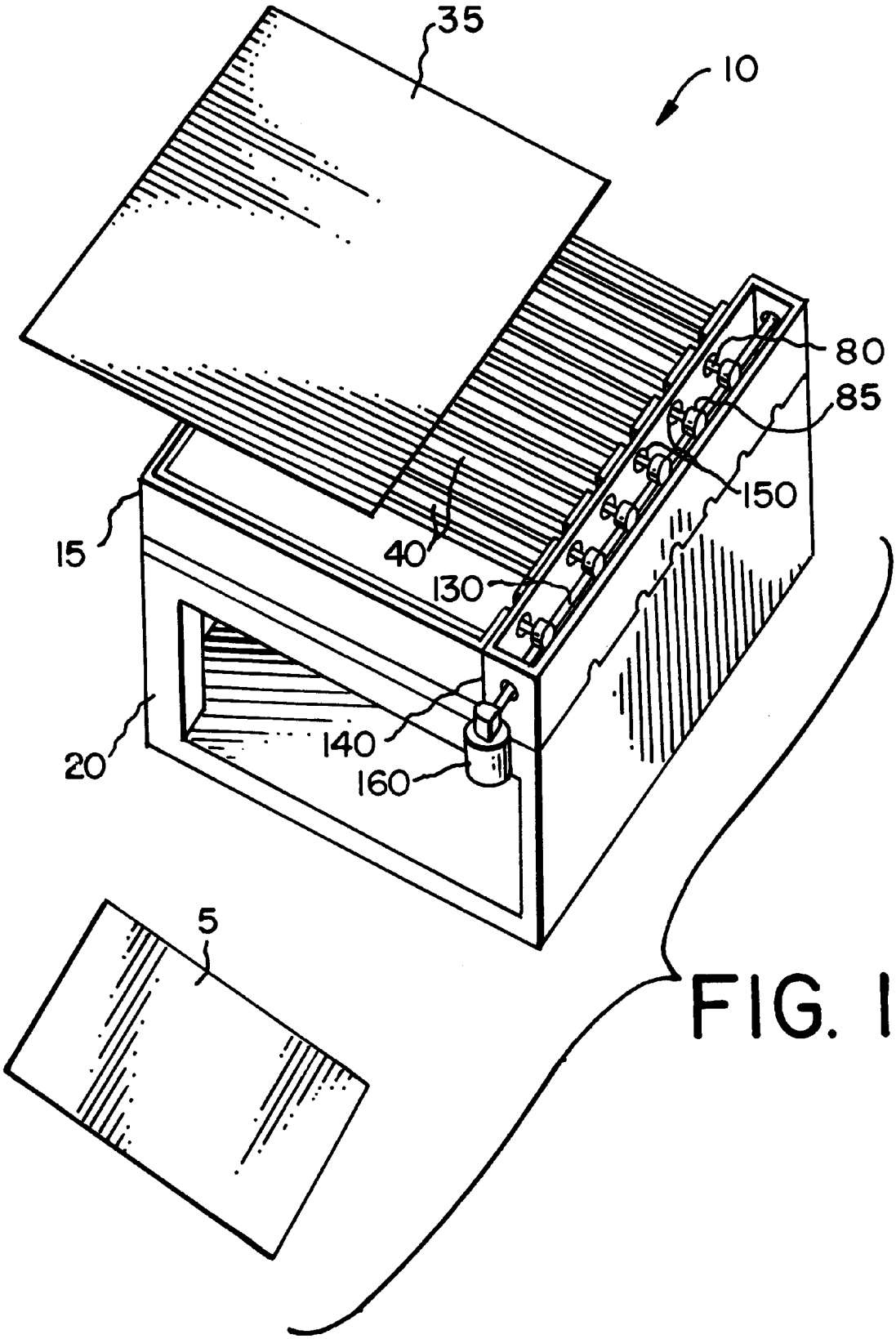
FIG. 1 is a perspective view of a film processor.

Referring to FIG. 1, there is illustrated a perspective view of a processing module 10 for forming a continuous low volume unit for processing photosensitive materials 5. The module 10 includes a stand 20 for elevating the top portion 15 of the module 10 for ease of use. The top portion 15 of the module 10 includes a plurality of tanks 40 that together contain the processing solutions for the module 10. It is instructive to note that each tank 40 includes substantially similar components therein, and for brevity, only one tank will be described hereinbelow although it is to be understood that the following description of the components of the tank applies to each tank 40. A top 35 is placed atop the top portion 15 for forming a closed enclosure.

Figure 2:
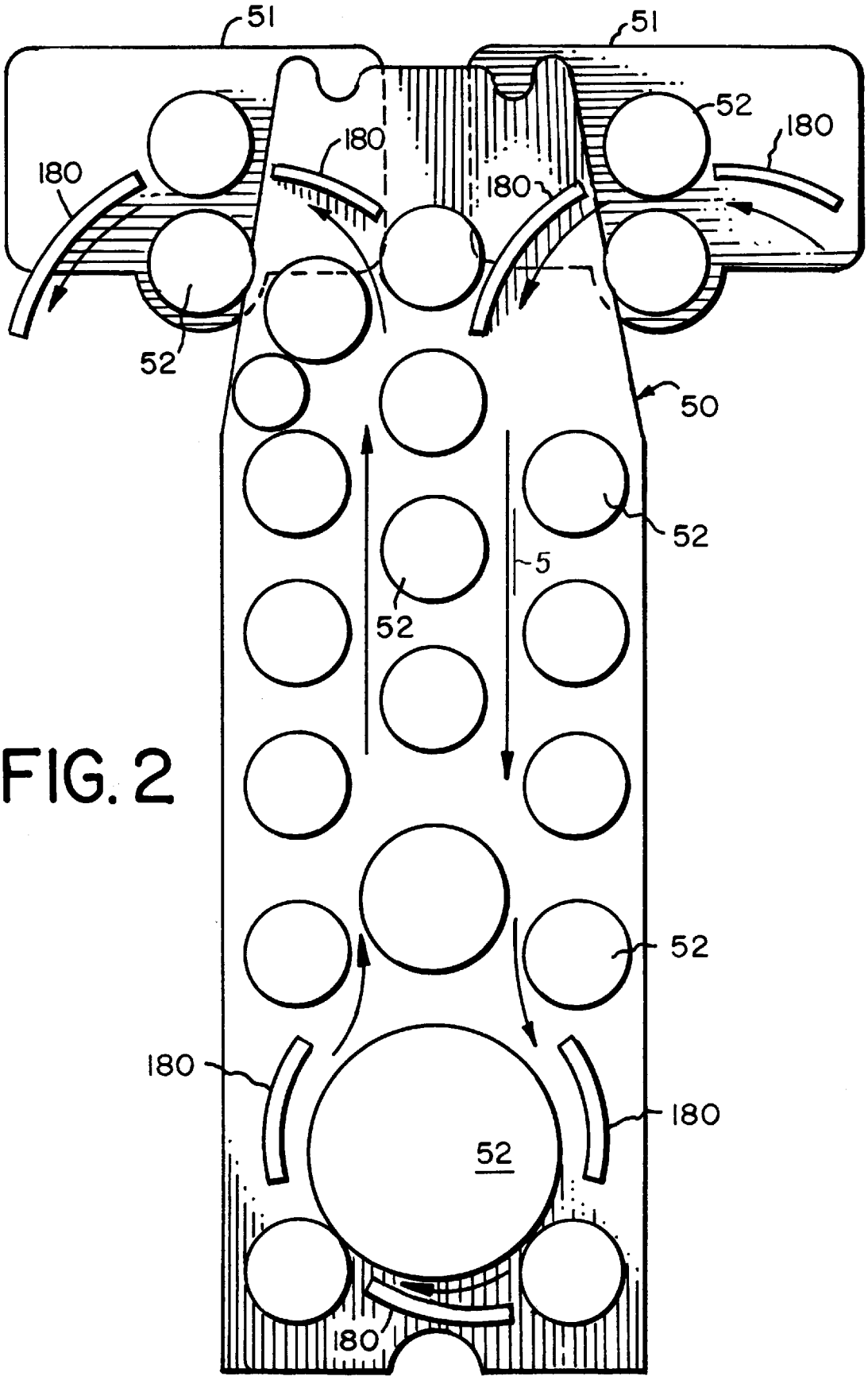
FIG. 2 is a perspective view of a tank of the film processor having a guideshoe of the present invention.

Referring now to FIGS. 1 and 2, the tank 40 includes a plurality of spaced apart racks 50 and crossovers 51 that are positioned in the tank 40 for permitting the processing solution to contact the photosensitive material 5 as the material 5 passes through the driven rollers 52 as illustrated by the arrows. The processing solutions pass through the racks 50 and tank 40, as is well known in the art and therefore will not be discussed in detail herein. The plurality of driven rollers 52 are paired together, and are disposed across the width of the rack 50 or crossover 51 for urging the photosensitive film 55 through the rack 40. The guideshoes 180 are placed at strategic predetermined locations within the racks 50 and crossovers 51 for directing the photosensitive film 55.

Figure 3:
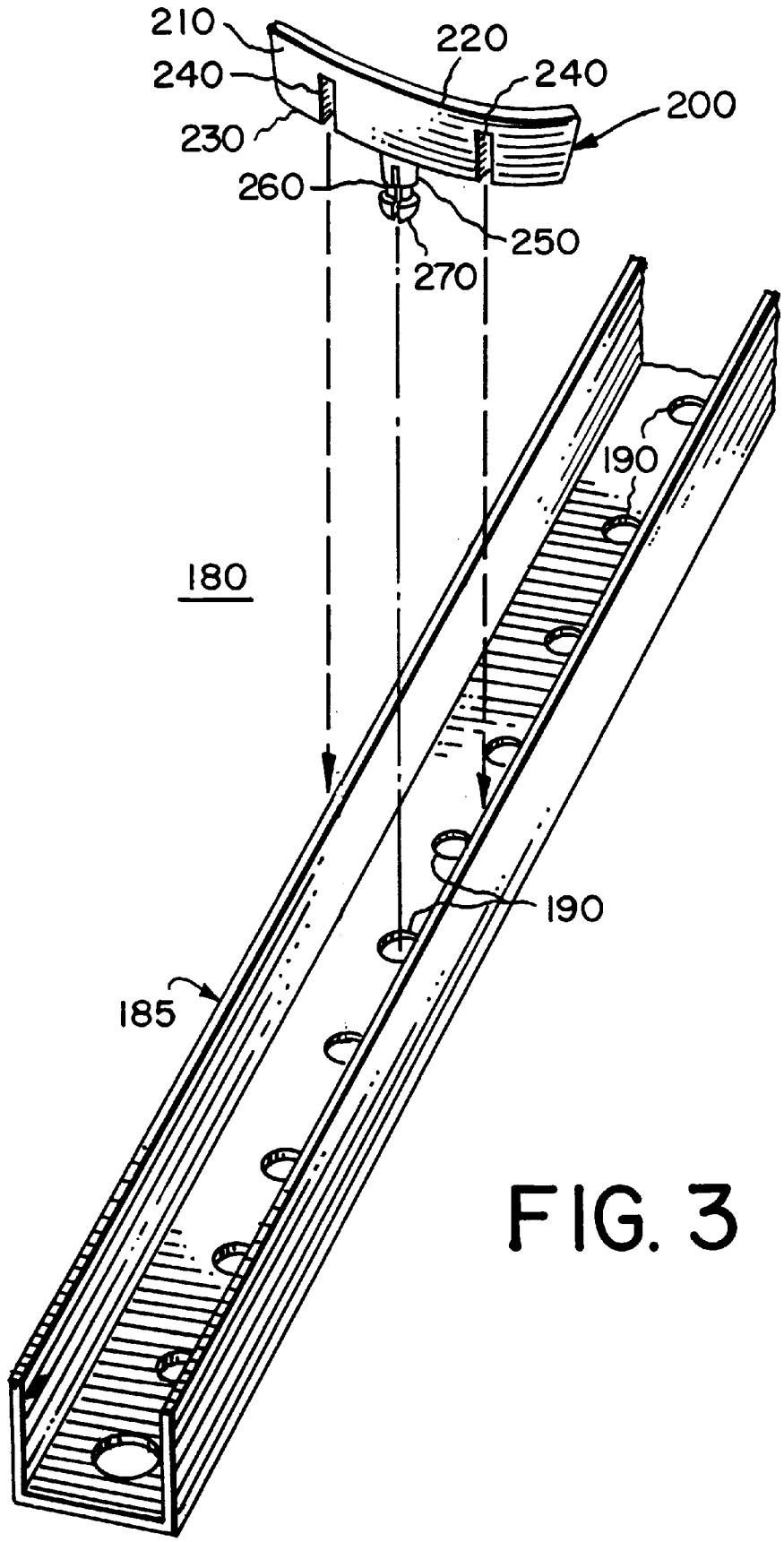
FIG. 3 is a perspective view of the guideshoe having field-replaceable guide ribs.

Referring to FIG. 3, there is illustrated the guideshoe 180 of the present invention. The crossover 180 includes an elongated, substantially U-shaped, three-sided base plate or stiffner 185 having a plurality of spaced-apart holes 190 disposed therethrough for respectively receiving a plurality of plastic guide ribs 200 (only one guide rib is shown). Each guide rib 200 includes a seat portion 210 having an arcuate-shaped outer surface 220 over which the photosensitive material or film passes. The seat portion 200 also includes an inner surface 230 having two slots 240 therein for respectively receiving a side or edge of the base plate 185 when it is inserted thereon for assisting in maintaining the guide rib 200 in its mated position to the base plate 185. The guide ribs 200 each further include a protruding nipple 250 that is inserted into a hole 190 of the base plate 185. The nipple 250 includes a channel 260 around its circumference that matingly mates with a hole 190 for also assisting in maintaining the guide ribs 200 in its mated position to the base plate 185, and the nipple 250 includes a rounded end portion having a slit 270 therein for permitting easy insertion of the nipple 250 into a hole 190.

It is instructive to note that the plastic guide ribs do not have the constraints of stainless steel in regard to shape and size. Stainless steel will fracture when the arcs of the ribs are formed below a certain radius, and as is well known in the art, small stainless steel ribs are difficult to manufacture and are difficult to weld to the stiffner. In addition, plastic guide ribs are less corrosive than stainless steel in the photographic chemistry.

The invention has been described with reference to a preferred embodiment. However, it will be appreciated that variations and modifications can be effected by a person of ordinary skill in the art without departing from the scope of the invention.

I claim:

1. A film processor for processing film, the processor comprising:

(a) a stifffier for providing a support device with a plurality of holes; and (b) a plurality of plastic guide ribs each including a flexible protruding portion which is manually attachable to and detachable from said holes in said stiffner so as to permit field replacement of said ribs, and said stiffner and guide ribs cooperatively form a structure for passing the film through the film processor.

2. The film processor as in claim 1, wherein said guide ribs are arcuate-shaped for permitting the film to pass through bends in the film processor.

3. The film processor as in claim 1, wherein said guide ribs include a channel circumferentially around the flexible protruding portion for assisting in maintaining the positional relationship of said guide ribs on said stiffner.

4. The film processor as in claim 3, wherein said guide ribs include a seat portion having two slits therein that are respectively received by two edges of said stiffner.

5. The film processor as in claim 4, wherein said stiffner is substantially U-shaped.

6. A processor for processing a medium, the processor comprising:

(a) a stiffner for providing a support device with a plurality of holes; and (b) a plurality of plastic guide ribs each including a flexible protruding portion which is manually attachable to and detachable from the holes in said stiffner so as to permit field replacement of said ribs, and said stiffner and guide ribs cooperatively form a structure for passing the medium through the processor.

7. The processor as in claim 6, wherein said guide ribs are arcuate-shaped for permitting the medium to pass through bends in the processor.

8. The processor as in claim 6, wherein said guide ribs include a channel circumferentially around the flexible protruding portion for assisting in maintaining the positional relationship of said guide ribs on said stiffner.

9. The processor as in claim 8, wherein said guide ribs include a seat portion having two slits therein that are respectively received by two edges of said stiffner.

10. The processor as in claim 9, wherein said stifiner is substantially U-shaped.

11. A guideshoe for directing a medium through a processor, the guideshoe comprising:

(a) a stiffner for providing a support device with a plurality of holes; and (b) a plurality of plastic guide ribs each including a flexible protruding portion which is manually attachable to and detachable from the holes in said stiffner so as to permit field replacement of said ribs, and said stiffner and guide ribs cooperatively form a structure for passing the medium through the processor.

12. The guideshoe as in claim 11, wherein said guide ribs are arcuate-shaped for permitting the medium to pass through bends in the processor.

13. The guideshoe as in claim 11, wherein said guide ribs include a channel circumferentially around the flexible protruding portion for assisting in maintaining the positional relationship of said guide ribs on said stiffner.

14. The guideshoe as in claim 13, wherein said guide ribs include a seat portion having two slits therein that are respectively received by two edges of said stiffner.

15. The guideshoe as in claim 14, wherein said stiffner is substantially U-shaped.

* * * * *